US007320318B1

(12) United States Patent
Tentler

(10) Patent No.: US 7,320,318 B1
(45) **Date of Patent: *Jan. 22, 2008**

(54) STRAP FOR BOW STRING RELEASE

(75) Inventor: Stephen M. Tentler, Fond du Lac, WI (US)

(73) Assignee: Tru-Fire Corporation, North Fond du Lac, WI (US)

( * ) Notice: Subject to any disclaimer, the term of this patent is extended or adjusted under 35 U.S.C. 154(b) by 323 days.

This patent is subject to a terminal disclaimer.

(21) Appl. No.: 10/793,131

(22) Filed: Mar. 4, 2004

Related U.S. Application Data

(63) Continuation-in-part of application No. 10/662,989, filed on Sep. 15, 2003, which is a continuation of application No. 10/646,358, filed on Aug. 22, 2003, now abandoned.

(51) Int. Cl.
*F41B 5/18* (2006.01)

(52) U.S. Cl. ..... 124/35.2; 224/267

(58) Field of Classification Search ..... 2/321, 2/322; 24/188, 189; 124/35.2; 224/164, 224/166, 221, 222, 267; 119/792, 793, 856, 119/857, 863, 864, 865
See application file for complete search history.

(56) References Cited

U.S. PATENT DOCUMENTS

| | | | | | |
|---|---|---|---|---|---|
| 2,041,944 | A | * | 5/1936 | Mestekin | 63/3 |
| 2,394,856 | A | * | 2/1946 | Hickman | 224/178 |
| 2,420,435 | A | * | 5/1947 | Lackow | 224/164 |
| 2,440,728 | A | * | 5/1948 | Siegel | 63/3 |
| 2,449,885 | A | * | 9/1948 | Domler | 224/164 |
| 2,996,059 | A | * | 8/1961 | Vance | 124/35.2 |
| 3,072,115 | A | * | 1/1963 | Johnson | 124/35.2 |
| 4,426,989 | A | * | 1/1984 | Sutton | 124/35.2 |
| 4,509,497 | A | * | 4/1985 | Garvison | 124/35.2 |
| 4,811,695 | A | * | 3/1989 | Higgins | 119/864 |
| 4,958,758 | A | * | 9/1990 | Tipple et al. | 224/267 |
| 5,595,167 | A | * | 1/1997 | Scott | 124/35.2 |
| 5,785,010 | A | * | 7/1998 | Koch | 119/863 |
| 5,937,841 | A | * | 8/1999 | Summers et al. | 124/35.2 |
| 6,125,833 | A | * | 10/2000 | Tentler et al. | 124/35.2 |
| 6,129,055 | A | * | 10/2000 | Hanada | 119/863 |

* cited by examiner

*Primary Examiner*—John A. Ricci
(74) *Attorney, Agent, or Firm*—Gerald E. Helget; Briggs and Morgan, P.A.

(57) ABSTRACT

A no stretch strap for a bow string release is provided to form a semi-closed (or open) hand receiving condition wrist strap for facilitating quick attachment and detachment of the strap to the wrist. The strap resists stretching and facilitates on-handed coupling about an archers wrist by selectively maintaining the semi-closed (or semi-open) hand receiving condition so that the archer does not have to manually insert a first end of the strap through a second end of the strap.

27 Claims, 7 Drawing Sheets

STRAP FOR BOW STRING RELEASE

RELATED APPLICATION

This application is a continuation-in-part of co-pending patent application Ser. No. 10/662,989 on Sep. 15, 2003 which is a continuation of patent application Ser. No. 10/646,358 filed 22 Aug. 2003, expressly abandoned.

BACKGROUND OF THE INVENTION

The invention is generally related to bow string releases and is specifically directed to a strap for a release.

Bow string releases are well known in the industry. Typically, a bow string release is designed to engage and lock a bow string in a mechanical sear for allowing the archer to pull the bow to its maximum draw. A trigger mechanism is then used to unlock the sear mechanism and release the string to fire the arrow.

As is typical, most bow string releases are secured to the wrist of the archer, permitting the release to be held in an at ready position while, freeing the fingers of the hand for other tasks. Also, by attaching the release to the archer at the wrist area, the amount of strain on the hand is greatly decreased when high draw weight bows are utilized, which is typical in archery hunting and archery tournaments. Many various straps and harnesses are available for bow string releases. An example of a widely accepted V-type strap is shown in U.S. Pat. No. 4,831,997 entitled: Wrist Strap, issued to Greene, on May 23, 1989. The strap has two ends that are placed around the wrist and then attached to each other by Velcro hook and loop material to secure the release strap and release to the wrist of the archer. The release or sear extends forwardly from the strap for gripping the bow string.

Another mechanism to couple the strap about the archer's wrist is to provide a receiver or belt-like buckle on a first end of the strap. The archer then must manipulate the second end of the strap through the receiver, and then place a pin on the receiver through a hole provided on the second end of the strap, similar to operation of a belt worn around a waist. This buckle style promotes exact strap location on your wrist every time.

Yes another mechanism includes a pistol-like grip from which the release extends forwardly. These grip style releases also include wrist straps for safety and for added pulling power.

Many currently available straps for bow string releases are difficult for the archer to couple about their wrist. This is because the strap remains proximal to the archers shooting hand, preventing the archer from using their shooting hand to assist the archer's off-hand in manipulating the strap. It has proven difficult for archers to one-handedly manipulate the second end of the strap through the receiver, and then place the pin on the receiver through the hole provided on the second end of the strap.

Additionally, repeated placement of the pin on the receiver through the hole provided on the second end of the strap cause the hole to stretch during repeated drawing of the bow during use. This stretch causes the hole on the second end of the strap to disadvantageously expand or rip. Also, with much repeated 50 to 70 pounds of pulling force exerted on the strap, it begins to stretch and separate or delaminate from its multiple layers.

Sizing of the straps may also be problematic for use with smaller wrists and/or when heavy clothing or gloves are not used. The overlapping strap portion may be too long and dangle causing interference with use of the bow string release.

SUMMARY OF THE INVENTION

This invention relates to an improved strap for a bow string release. According to preferred embodiments of the present invention, the strap has two ends, a first end and a second end. The first end of the strap is provided with a receiver for receiving a tab that is coupled with the second end of the strap.

Preferably, the tab on the second end of the strap is sized to allow the archer to place the tab of the second end through the receiver of the first end of the strap, and have the tab of the second end selectively remain through the receiver of the first end of the strap. This allows the archer to have the ability to have the second end of the strap already started through the receiver of the first end of the strap, easing the way in which archers couple the strap to their wrist.

Another advantage is to have a portion of the second strap end to be stretchable. This allows the looped strap to pass over the hand or gloved and minimizes the material needed to make the strap.

According to another aspect of the present invention, the strap is constructed in multi-layer fashion, a first padded layer that provides comfortable contact with the archer's skin and a second non-stretchable layer that provides the strap with a robust design that prevents the strap from stretching, ripping, delaminating and prevents holes in the strap from expanding through repeated use, among other benefits.

Another advantage is to have to have a movable clip on the first portion to secure the stretchable end of the second portion to prevent flapping, dangling, or interference by the second end portion.

DESCRIPTION OF THE PREFERRED EMBODIMENT

Although the disclosure hereof is detailed and exact to enable those skilled in the art to practice the invention, the physical embodiments herein disclosed merely exemplify the invention that may be embodied in other specific structures. While the preferred embodiments have been described, the details may be changed without departing from the invention, which is defined by the claims.

Figure 1:
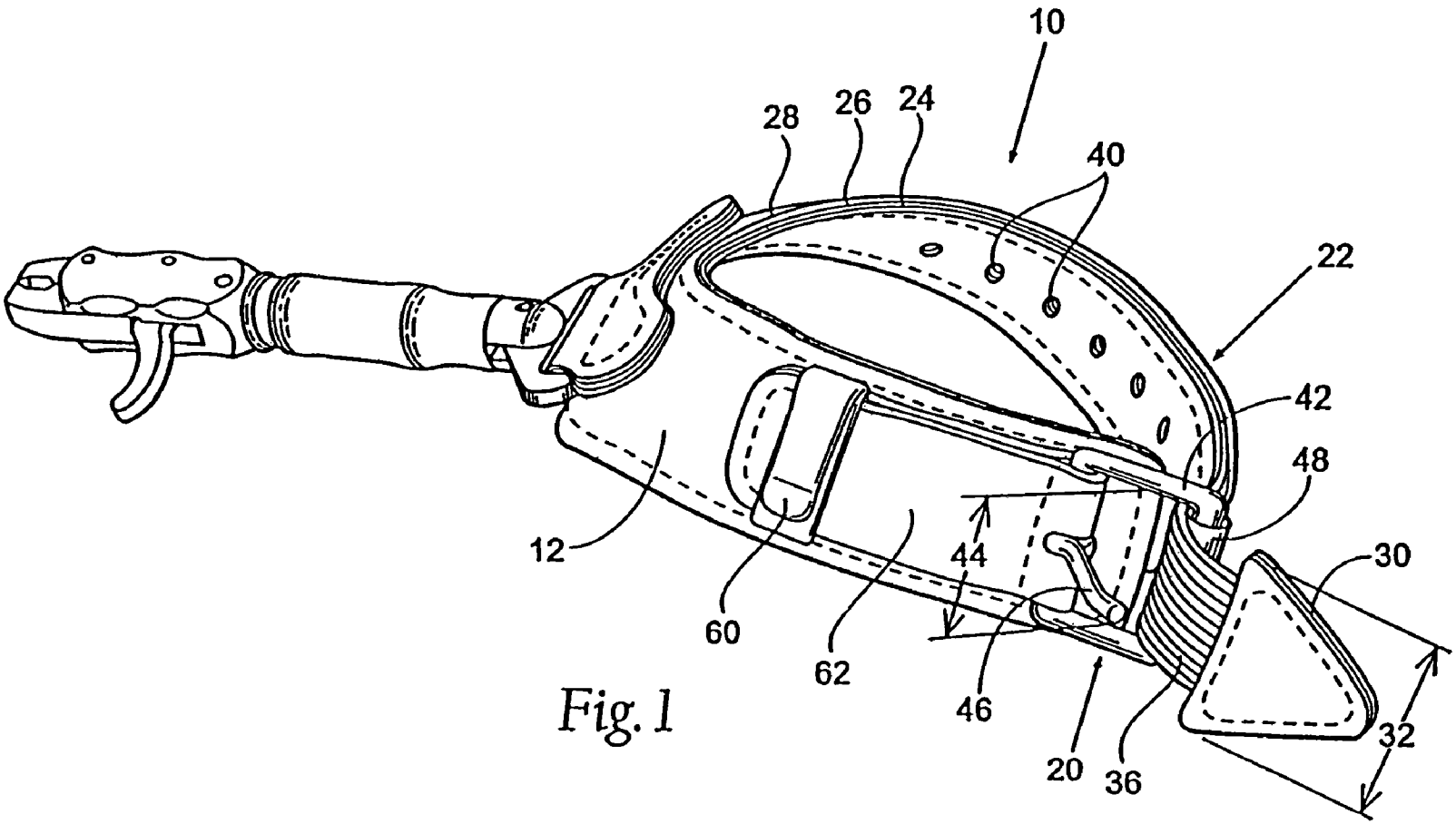
FIG. 1 is a perspective view of a preferred embodiment of a strap for a bow string release.

Referring now to FIG. 1, a perspective view of a preferred embodiment of a strap 12 for a bow string release 10 is shown. The strap 12 has two ends, a first end 20 and a second end 22. It is noted that reference to either the first end 20 or the second end 22 refers generally to the last segments of the strap 12, not to the absolute extremities of the strap 12. The first end of the strap 12 is provided with a receiver or buckle 42 for receiving a tab 30 that is coupled with the second end 22 of the strap 12 by way of an elastic strap member 36 made of elastic synthetic textile fibers, like spandex or lycra.

Preferably, the tab on the second end 22 of the strap 12 is sized to allow the archer to place the tab 30 of the second end 22 through the receiver or buckle 42 of the first end 20 of the strap 12, and have the tab 30 of the second end 22 selectively remain through the receiver 42 of the first end 20 of the strap 12. This allows the archer to have the ability to have the second end 22 of the strap 12 already started through the receiver 42 of the first end 20 of the strap 12, easing the way in which archers couple the strap 12 to their wrist. It is understood that the first end may refer to either end of the strap, as long as the strap has two ends.

It is preferable to shape the tab 30 as a triangle, as shown, in order to ease folding of the tab 30 to fit through the receiver 42, although other shapes, such as circular or square, may be readily used.

The receiver 42 is coupled with a receiver pin 46 which can be inserted into holes 40 on the strap 12, in belt fashion. The receiver 42 also preferably has a receiver roller 48 to facilitate sliding of the second end of the strap 22 through the receiver 42. It should be understood that other means for maintaining the second end 22 in a semi-closed position relative to said first end 20 may be used, such as a hook and loop attachment.

Still referring to FIG. 1, but also shown in FIGS. 2-5, according to another aspect of the present invention, the strap 12 is constructed preferably in multi-layer fashion, a first preferably padded layer 24 that provides comfortable contact with the archer's skin. A second substantially non-stretchable layer 26 prevents the strap 12 from stretching, and also advantageously prevents holes 40 in the strap 12 from expanding through repeated use and the placing of a pulling load on the holes 40 by a receiver pin 46. Preferably, the second layer 26 is formed with a nylon ballistic, minimal or no stretch, material. Polyester fabric or webbing will work well as will durable plastics like vinyl laminates which resist stretching and ripping. Optionally, a third layer 28 is provided on the outermost portion of the strap 12, the third layer 28 preferably formed from a material such as fabric, leather or leather-like material, such as vinyl, nylon, camouflage fabric to give the strap 12 an appealing appearance. Common techniques for fabric coupling include sewing and adhesives, although any suitable coupling mechanism can be used.

The shape of the strap 12 is shown in a V-shaped pattern, although the strap 12 can take on other configurations to suit the archers wrist.

Figure 2:
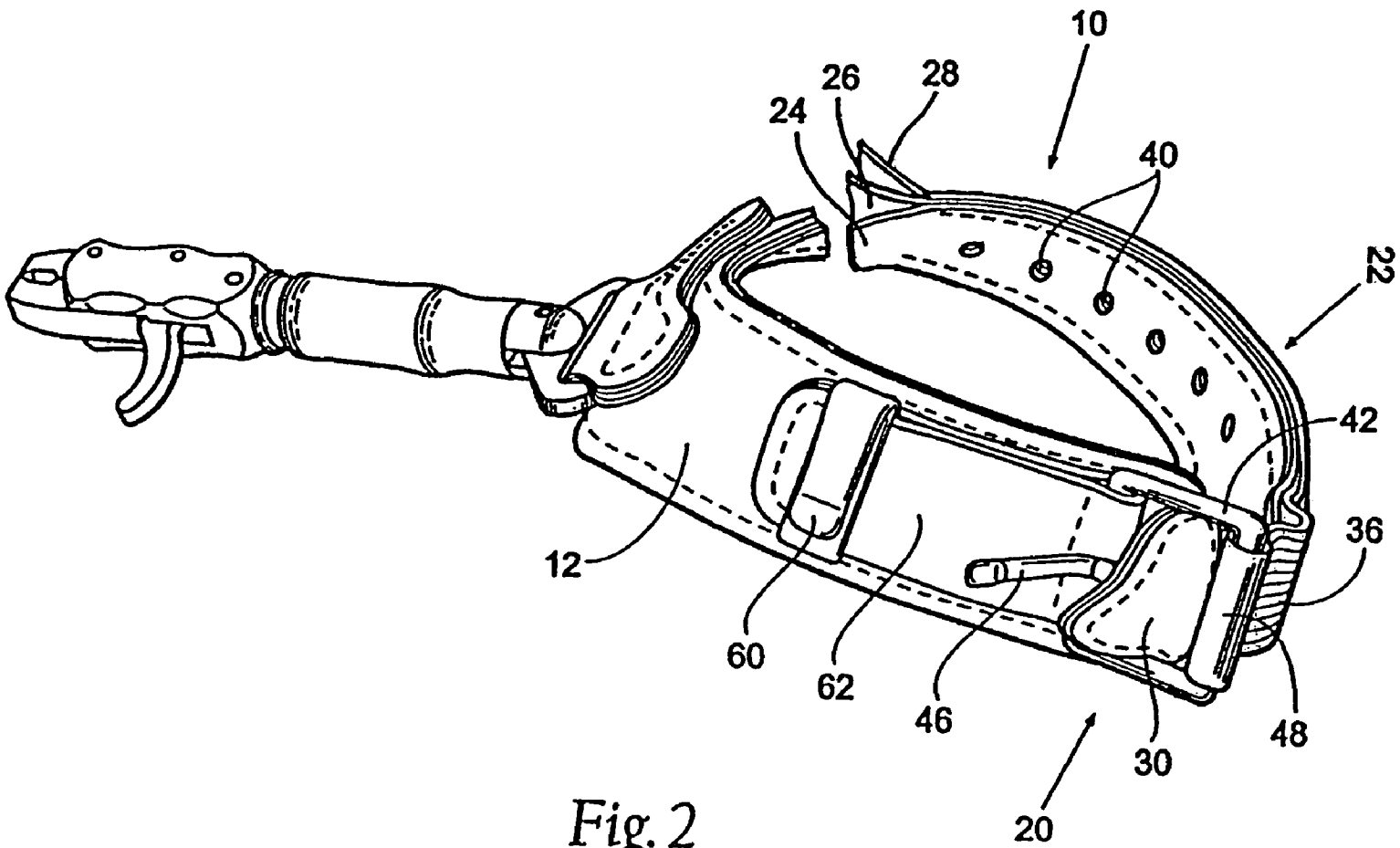
FIG. 2 is a perspective view of a preferred embodiment of a strap for a bow string release, the strap to be coupled about an archers wrist, the strap in an open position.

Referring now to FIG. 2, the strap 12 is shown to be coupled about an archer's wrist, the strap 12 in an open position as shown. In this open position, the second end of the strap 22 has been withdrawn from the receiver 42 by flexing the tab 30 to decrease its effective width from its ordinary strap width 32, which is preferably greater than the arrow width 44 (FIG. 1) of the receiver, until the tab arrow width 32 (FIG. 1) is decreased by folding or otherwise, as shown in FIG. 2. It is believed that archers will prefer to keep the strap 12 in a semi-open position when the release is not in use, as described with relation to FIG. 1, in order to avoid having to manipulate the second end 22 of the strap 12 through the receiver 42.

Figure 3:
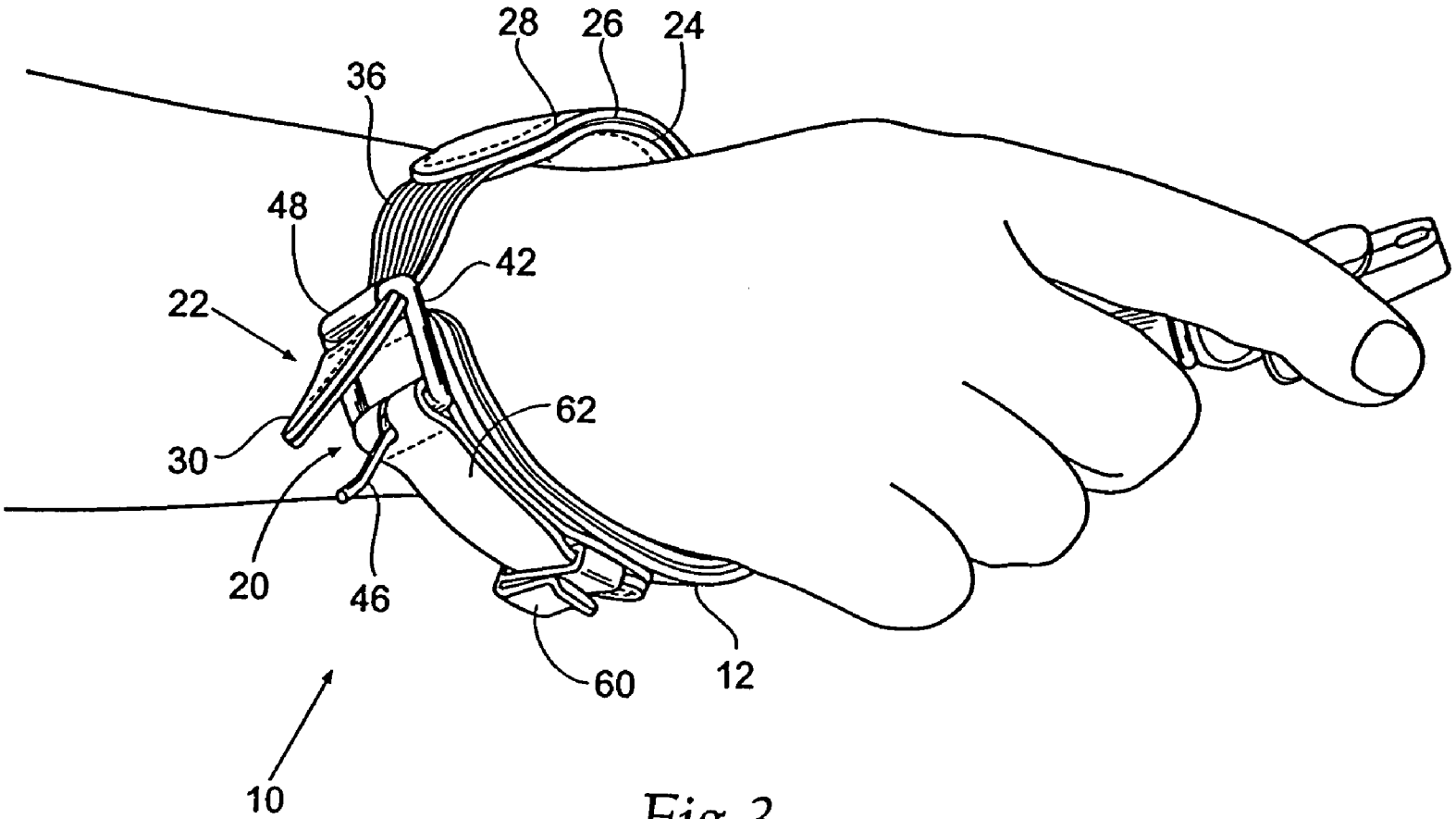
FIG. 3 is a perspective view of a preferred embodiment of a strap for a bow string release, the strap coupled about an archers wrist, the strap in a semi-closed (or open) position.

Referring now to FIG. 3, the strap 12 is shown in a semi-open position. In this position, the archer has initially stretched elastic member 36, placed his wrist into the strap 12, but has not yet coupled the receiver pin 46 into any one of the holes 40 (not visible in FIG. 3)

Figure 4:
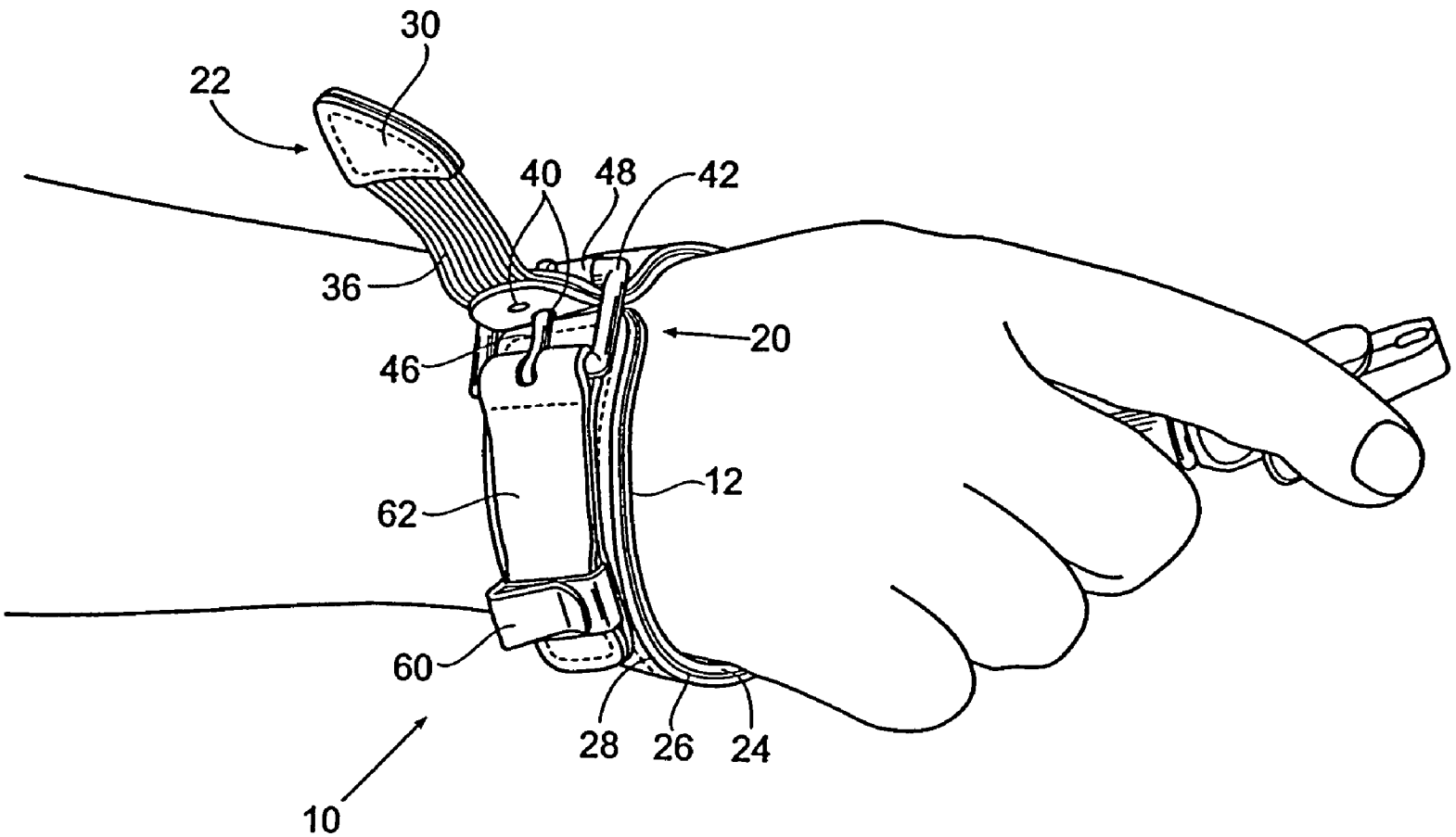
FIG. 4 is a perspective view of a preferred embodiment of a strap for a bow string release, the strap coupled about an archers wrist, the strap in a closed position.

Referring now to FIG. 4, the strap 12 is shown in a closed position. In this position, the archer has initially placed his wrist into the strap 12, and has now coupled the receiver pin 46 into any one of the holes 40 to secure the strap about the wrist.

Figure 5:
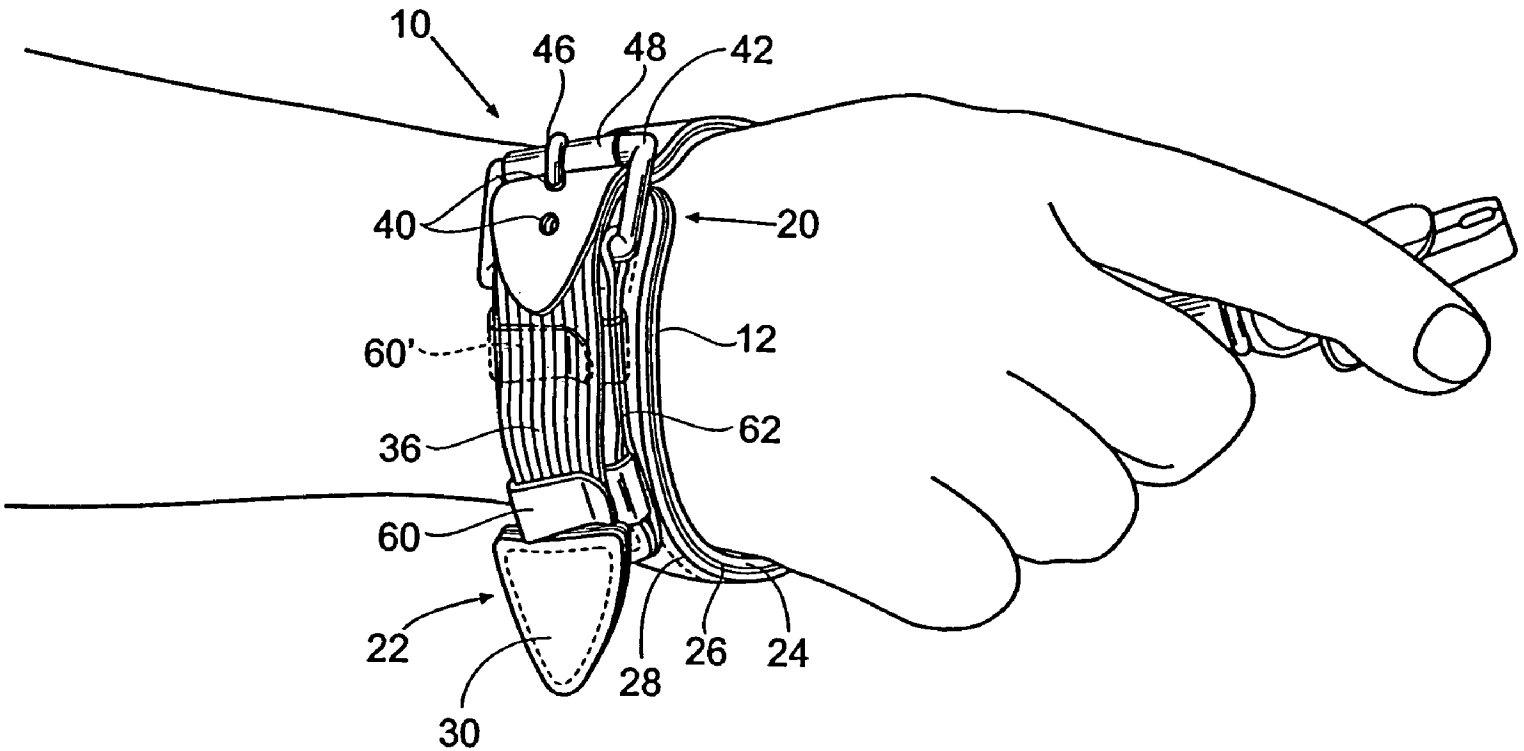
FIG. 5 is a perspective view of a preferred embodiment of a strap for a bow string release, the strap coupled about an archers wrist, the strap in a closed position, and a tab of the strap in a restrained position.

Referring now to FIG. 5, the strap 12 is shown coupled about an archers wrist, the strap in a closed position, and the tab 30 of the strap 12 is in a restrained position. In this restrained condition, a portion of the second end of the strap 22, preferably the elastic member 36, has been placed into clip 60. The first end of the strap 20 has a clip 60 coupled to the strap 12 by a clip receiver strap 62. The clip receiver strap 62 preferably allows the clip 60 to slide laterally to engage the tab 30 for a wide variety of wrist sizes, and to keep the second end of the strap 22 relatively secured to the strap 12 itself. The clip 60 is also shown in a second position 60' although the clip 60 preferably has the capability to slide along a range of lengths along the receiver strap 62. The elastic member 36 enables the second end of the strap 22 to be restrained, yet avoids the receiver pin 46 from being inadvertently withdrawn from a hole 40, as could be possible with an archer having a large wrist size.

Figure 6:
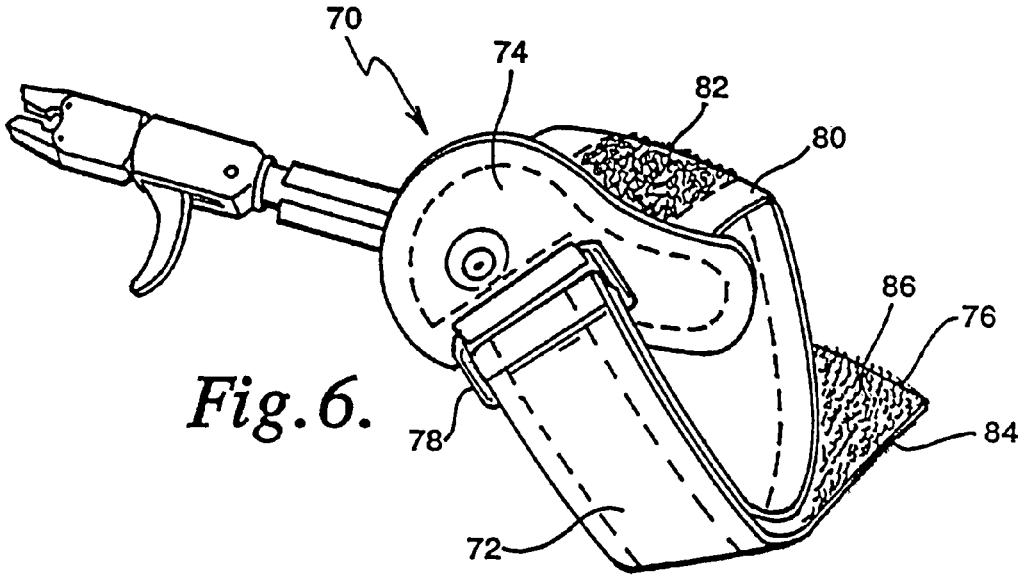
FIG. 6 is a perspective view of another preferred embodiment of a strap for a bow string release securable with hook and loop material.
Figure 7:
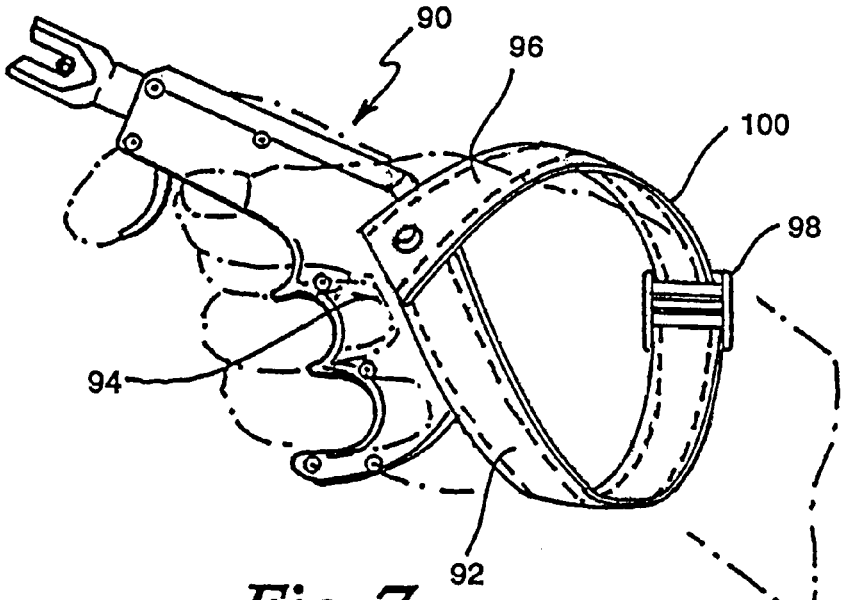
FIG. 7 is a perspective view of another preferred bow string release with a grip style having a strap securable with hook and loop material.

Another preferred embodiment of strap 72 for a bow string release 70 is shown in FIG. 6. Strap 72 is continuous extending from jaw or sear mount 74 to form a loop as the end 76 of strap 72 pass through buckle or rectangular eyelet 78 also on mount 74. The outside first portion 80 of strap 72 has Velcro loops 82 while the outside second portion 84 has Velcro hooks 86. By this arrangement, strap 72 is past through buckle 78, pulled and laid back upon itself to lock the hook and loop materials 82 and 86 to secure the strap 72 and release 70. Strap 72 also includes a layer of no-stretch material 26 as shown in FIG. 2.

Another preferred embodiment is grip-style bow string release 90. Non-stretch strap 92 extends from grip 94 having a first portion 96 having a buckle 98 and a second portion 100 which loops through buckle 98 and may be anchored upon itself by hook and loop materials.

Figure 8:
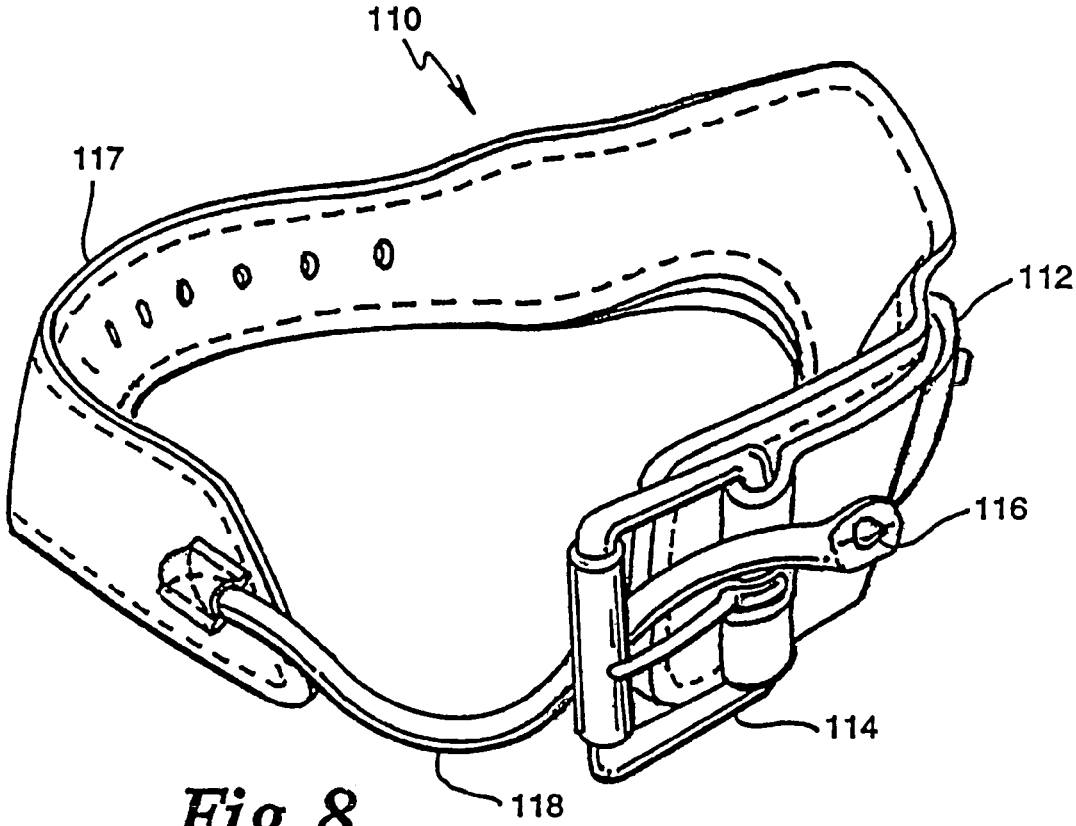
FIG. 8 is a perspective view of another preferred looped strap embodiment for a bow string release.
Figure 9:
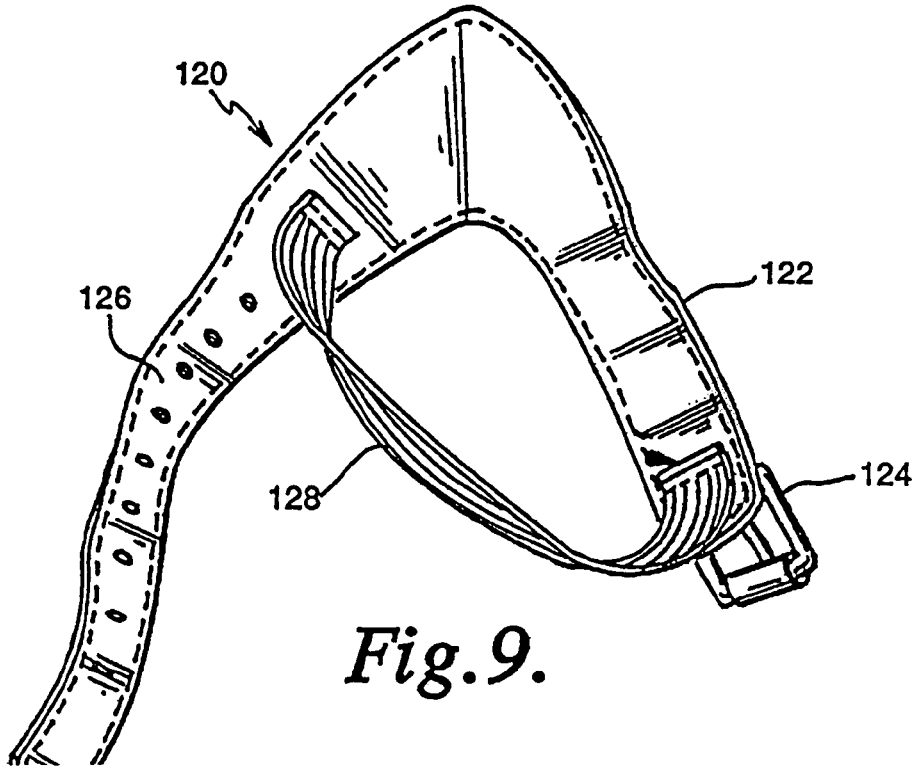
FIG. 9 is a perspective view of yet another preferred loop strap embodiment for a bow string release.

FIGS. 8 and 9 show two other preferred strap embodiments 110 and 120. Strap 110 is V-shaped, non-stretchable and has a first portion 112 with receiver 114 with a permanent of releasable strap anchor 116. Loop strap 118 may be of a non-stretchable coated cable or stretchable or elastic material and extends from the second portion 117, through buckle 114 to anchor 116. By this arrangement, a loop is created for easy donning and securing the first portion 112 with buckle 114. Strap 120 is also V-shaped, nonstretchable and has a first portion 122 with receiver 124. Second portion 126 may be secured to first portion 122 by any buckle-like arrangement 124 previously described. Loop strap 128 permanently connects first and second portions 122 and 126 and may be stretchable for easy donning.

It is understood that alternative embodiments of the present invention could also be employed to selectively maintain the second end 22 of the strap 12 through first end 20 of the strap, such alternative embodiments are not shown in the drawings. This could be accomplished by having a piece of cord fastened to the second end 22, and then weaving the cord through the receiver. Alternatively, an elastic member could be coupled with the first end 20, and then coupled with the second end 22.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A bow string release, comprising:

a) a mechanical sear and trigger mechanism for gripping a bow string of a bow to draw and release the bow;

b) a wrist strap of substantially no stretch no rip material connected to the mechanical sear and trigger mechanism and securable about a wrist of an archer's hand to reduce hand strain and to free fingers for other tasks; and c) further comprising a multilayer strap wherein the second layer is a padded layer to provide comfortable contact with the archer's skin.

2. The release of claim 1, wherein the strap has a first end and a second end, the first end comprising a receiver having an opening for receiving the second end.

3. The release of claim 2, wherein the second end further comprises a member coupled with the first member end forming a loop to assist the archer in donning the strap about the wrist.

4. The release of claim 2, wherein the second end further comprises at least one hole provided on the strap for selectively receiving a pin coupled with receiver thereon the first end.

5. A strap for a bow string release, comprising:

a) first and second ends on the strap;

b) a receiver with a pin coupled thereto on the first end and having an opening with a width;

c) at least one hole on the second end for selectively receiving the pin to secure the first and second ends together about the wrist;

d) a member with a tab extending from the second end, the tab having a greater width than the width of the receiver opening to form a loop with the tab through the receiver to assist the archer in donning the strap about the wrist.

6. The release of claim 5, wherein the member is elastic.

7. The release of claim 5 wherein the strap is made from a group of materials comprising a ballistic nylon, a polyester fabric, a polyester webbing and a vinyl laminate.

8. The release of claim 5, comprising a multilayer strap wherein the second layer is a padded layer to provide comfortable contact with the archer's skin.

9. The release of claim 8, comprising a third layer of a material to give the strap an appealing appearance.

10. A strap for a bow string release, comprising:

a) first and second ends on the strap;

b) a receiver on the first end and having an opening with a width;

c) the second end being adapted for selectively securing to the receiver thereby securing the first and second ends together about the wrist;

d) a member with a tab extending from the second end, the tab having a greater width than the width of the receiver opening to form a loop with the tab through the receiver to assist the archer in donning the strap about the wrist.

11. The release of claim 10, wherein the member is elastic.

12. The release of claim 10, wherein the strap is made from a group of materials comprising a ballistic nylon, a polyester fabric, a polyester webbing and a vinyl laminate.

13. The release of claim 10, comprising a multilayer strap wherein the second layer is a padded layer to provide comfortable contact with the archer's skin.

14. The release of claim 13, comprising a third layer of a material to give the strap an appealing appearance.

15. A strap for a bow string release, comprising:

a) first and second ends on the strap;

b) a receiver on the first end;

c) the second end being adapted for selectively securing to the receiver thereby securing the first and second ends together about the wrist; and d) a member extending from the second end to the first end to selectively form a loop to assist the archer in donning the strap about the wrist.

16. The release of claim 15, wherein the member is elastic.

17. The release of claim 15, wherein the strap is made from a group of materials comprising a ballistic nylon, a polyester fabric, a polyester webbing and a vinyl laminate.

18. The release of claim 15, comprising a multilayer strap wherein the second layer is a padded layer to provide comfortable contact with the archer's skin.

19. The release of claim 18, comprising a third layer of a material to give the strap an appealing appearance.

20. A strap for a bow string release, comprising:

a) first and second ends on the strap wherein the strap is made of a substantially no stretch no rip material;

b) a receiver with a pin coupled thereto on the first end and having an opening with a width;

c) at least one hole on the second end for selectively receiving the pin to secure the first and second ends together about the wrist; and d) a member with a tab extending from the second end, the tab having a greater width than the width of the receiver opening to form a loop with the tab through the receiver to assist the archer in donning the strap about the wrist.

21. The release of claim 20, wherein the member is elastic.

22. The release of claim 20, wherein the strap is made from a group of materials comprising a ballistic nylon, a polyester fabric, a polyester webbing and a vinyl laminate.

23. The release of claim 20, comprising a multilayer strap wherein the second layer is a padded layer to provide comfortable contact with the archer's skin.

24. The release of claim 23, comprising a third layer of a material to give the strap an appealing appearance.

25. A bow string release, comprising:

a) a mechanical sear and trigger mechanism for gripping a bow string of a bow to draw and release the bow; and b) a wrist strap of substantially no stretch no rip material connected to the mechanical sear and trigger mechanism and securable about a wrist of an archer's hand to reduce hand strain and to free fingers for other tasks, comprising a multilayer strap wherein the second layer is a padded layer to provide comfortable contact with the archer's skin.

26. A bow string release, comprising:

a) a mechanical sear and trigger mechanism for gripping a bow string of a bow to draw and release the bow; and b) a wrist strap of substantially no stretch no rip material connected to the mechanical sear and trigger mechanism and securable about a wrist of an archer's hand to reduce hand strain and to free fingers for other tasks, wherein the strap is made from a group of materials consisting of a ballistic nylon, a polyester fabric, a polyester webbing and a vinyl laminate.

27. A bow string release, comprising:

a) a mechanical sear and trigger mechanism for gripping a bow string of a bow to draw and release the bow;

b) a wrist strap of substantially no stretch no rip material connected to the mechanical sear and trigger mechanism and securable about a wrist of an archer's hand to reduce hand strain and to free fingers for other tasks;

c) further comprising a multilayer strap wherein the second layer is a padded layer to provide comfortable contact with the archer's skin; and d) further comprising a third layer of a material to give the strap an appealing appearance.

* * * * *

UNITED STATES PATENT AND TRADEMARK OFFICE

CERTIFICATE OF CORRECTION

PATENT NO. : 7,320,318 B1
APPLICATION NO. : 10/793131
DATED : January 22, 2008
INVENTOR(S) : Stephen M. Tentler and Lynn A. Tentler It is certified that error appears in the above-identified patent and that said Letters Patent is hereby corrected as shown below:

Title page, item [75] "Inventor:" add -- Lynn A. Tentler, Cape Coral, FL (US) --

Signed and Sealed this

Sixteenth Day of September, 2008

JON W. DUDAS
*Director of the United States Patent and Trademark Office*